US005188565A

United States Patent [19]

Hauck

[11] Patent Number: 5,188,565

[45] Date of Patent: Feb. 23, 1993

[54] NOVELTY DEVICE AND METHOD OF USING SAME

[76] Inventor: Lane T. Hauck, 5346 Bragg St., San Diego, Calif. 92122

[21] Appl. No.: 683,861

[22] Filed: Apr. 11, 1991

[51] Int. Cl.[5] ..... A63J 23/00

[52] U.S. Cl. ..... 472/51; 472/57

[58] Field of Search ..... 472/51-56, 472/57, 64, 66, 72

[56] References Cited

U.S. PATENT DOCUMENTS 616,085 12/1898 De Moulin et al. ..... 472/53
811,702 2/1960 Cook ..... 472/56
1,044,801 11/1912 Miller ..... 472/53
1,271,057 7/1918 Millhouse ..... 472/53
4,206,913 6/1980 Howell, Jr. et al. ..... 472/53

*Primary Examiner*—Richard E. Chilcot, Jr.
*Attorney, Agent, or Firm*—Bernard L. Kleinke; Jerry R. Potts; William Patrick Waters

[57] ABSTRACT

A novelty device and method of using it, include the generation of an attention attracting signal, under the control of the performer but not by the spectator. A secret disabling arrangement causes a spectator to be unable to re-activate the attention attracting device. A resetting device causes the novelty device to be reset in a surreptitious manner to permit the performer to re-activate the attention attracting device.

13 Claims, 2 Drawing Sheets

NOVELTY DEVICE AND METHOD OF USING SAME

TECHNICAL FIELD

The present invention relates in general to a novelty device, and a method of using it. The invention more particularly relates to such a novelty device, which is also capable of functioning as a magic trick.

BACKGROUND ART

Novelty devices have been employed for many years for the purpose of entertaining people. Such novelty devices have included loops and rings, which have been linked together in such a manner that the user can quickly and easily disconnect them. However, the spectator, when asked to perform such a feat, is unable to duplicate it.

While such devices are amusing, they are not always very challenging to more sophisticated or educated persons. In this regard, adult people, including engineers and scientists, might not find such a novelty item or puzzle to be very amusing or challenging. In this regard, such an engineer or scientist may well be able to quickly and easily determine the secret for solving the puzzle, by a mere visual inspection in a relatively short period of time. Thus, it would be highly desirable to have a novelty device which is very entertaining, and not subject to learning the secret to solving the puzzle in a ready manner, even by sophisticated adults who may have technical education or experience.

Such novelty devices have included magical apparatus used by magicians in performing magic tricks on the stage. For example, there have been remotely controlled devices employing radio frequency signals to enable the magician performer to activate secretly a device at a distance. However, such an apparatus is not at all susceptible to examination by the audience, without revealing the secret of its operation. Certainly, an engineer or scientist could readily inspect such an apparatus and determine exactly how it operates. The radio transmitter or receiver would be apparent by visual inspection, and the thought process of the more sophisticated spectator could readily analyze the device to determine the nature of its operation.

Thus, it would be highly desirable to have a novelty device which is constructed and arranged such that its operation is not readily susceptible to detection by an audience, including highly trained and skilled persons who might otherwise be able to analyze and determine the nature of the operation of the device. Such a device should be relatively inexpensive to manufacture, as compared to more expensive novelty equipment, such as radio controlled apparatus or the like.

Such a novelty device should not only be capable of deceiving a technically sophisticated person for entertainment purposes, but it should also be portable and light in weight. It should also be small and compact in size, so that the user can readily carry it with him or her, whereby it can be used on a variety of occasions. It should be able to be used by unskilled persons who do not possess a background and experience in highly technical fields, even though an engineer or scientist observing such a novelty device would be unable to ascertain how it function.

DISCLOSURE OF INVENTION

Therefore, the principal object of the present invention is to provide a new and improved novelty device and method of using it, wherein a technically unsophisticated user can operate the device in a baffling and entertaining manner, without permitting a technically experienced person knowing how the novelty device functions.

Another object of the present invention is to provide such a new and improved novelty device and method of using it, such that the novelty device is relatively inexpensive to manufacture, and it is portable and light in weight so that it is susceptible to being carried by the user in a convenient manner.

Briefly, the above and further objects of the present invention are realized by providing a novelty device and method of using it, such that an ordinary unskilled person can operate the device in a very baffling and entertaining manner, without disclosing to others the nature of its operation. The device is relatively inexpensive to manufacture, and is light in weight and portable.

A novelty device and method of using it, include the generation of an attention attracting signal, under the control of the performer but not by the spectator. A secret disabling arrangement causes a spectator to be unable to re-activate the attention attracting device. A resetting arrangement causes the novelty device to be reset in a surreptitious manner to permit the performer to re-activate the attention attracting device.

The novelty device can be held in the hand and is deceptively simple in appearance. The disabling device includes in the preferred form of the invention, a simple slide switch which appears to control the operation of the attention attracting device. When in reality, the slide switch prevents the spectator from re-activating the attention attracting device, even though the performer is able to control the activation of the attention attracting device at will. Unknown to the spectator, the resetting device enables the novelty device to be reset in such a manner that a sophisticated spectator, such as an engineer or scientist, would probably be unaware of such a resetting device by casual inspection of the novelty device. Thus, the novelty device is highly entertaining and is capable of being used to deceive even a technically trained spectator in an entertaining manner, such as in the performance of a magic trick.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
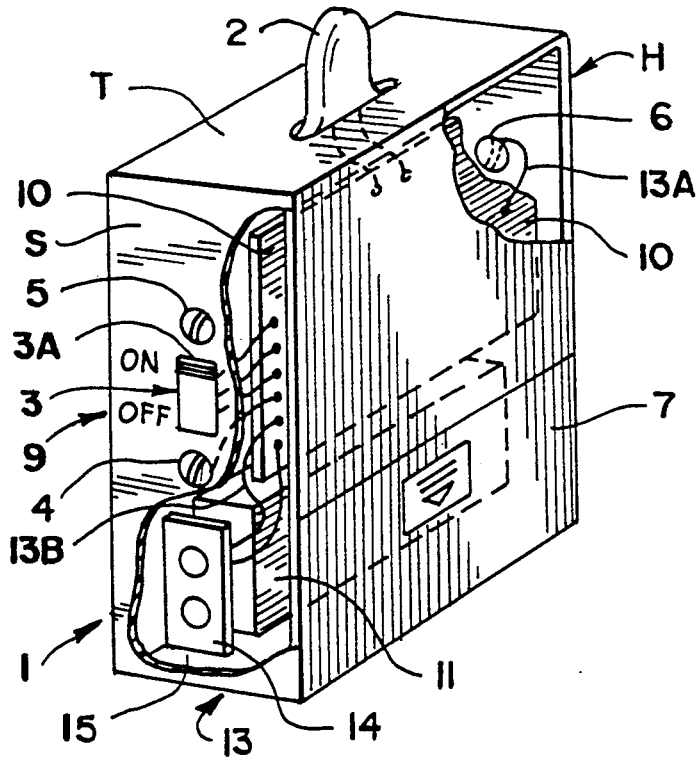
FIG. 1 is a partially broken away pictorial view of a novelty device, which is constructed in accordance with the present invention.
Figure 2:
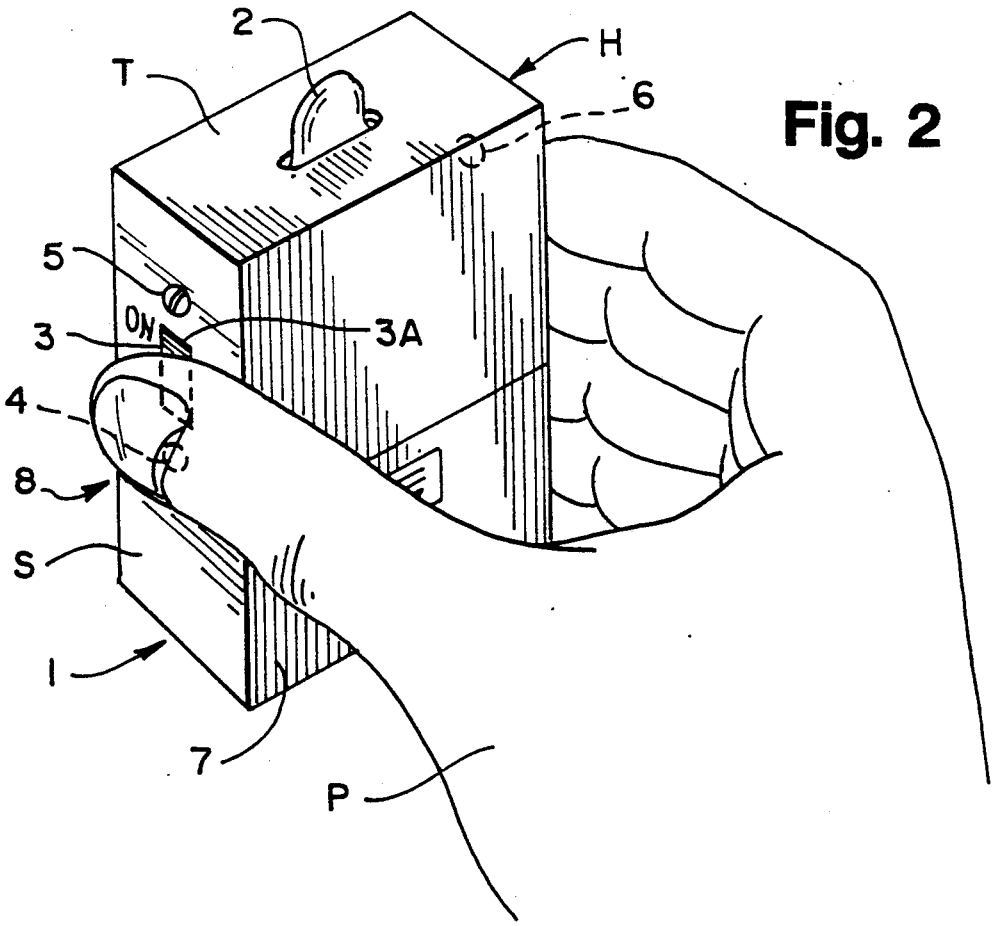
FIG. 2 is a pictorial view of the novelty device of FIG. 1, illustrating it in the process of being used.

Referring now to the drawings, and more particularly to FIGS. 1 and 2 thereof, there is shown a novelty device 1, which is constructed in accordance with the present invention, and which is adapted to be held in a hand P of a performer for entertainment purposes. The device 1 can function either as a puzzle to be viewed by a spectator, or the device 1 can be used by a performer who is a magician using the device 1 as a magic trick.

The novelty device 1 includes a hand-held housing H, which is boxlike in configuration and rectangular in shape. An attention attracting device, in the form of a light emitting diode 2 mounted on a top wall T of the housing H, is illuminated by the hand P, but can not be illuminated by a spectator who is not knowledgeable of the secret of its operation. A slide switch 3 mounted on a side wall S of the housing H by a pair of spaced-apart mounting screws 4 and 5, is manually actuatable by the hand P to appear to be the control of the diode 2. For the purpose of enabling the hand P to prepare for the activation of the light emitting diode 2, as hereinafter described in greater detail, a screw (FIG. 2) on an opposing side wall of the housing H cooperates with the screw 4 to provide a touch switch generally indicated at 8, to enable the thumb and first finger of the hand P to touch the respective screws 4 and 6 to complete a high resistance circuit there between for activating secretly without the knowledge of spectator, the light emitting diode 2. As generally shown in FIG. 1, a disabling circuit 9 including the slide switch 3 and circuit components shown and described more completely in FIG. 3 to be mounted on a circuit board 10 within the housing H, enable the hand P to disable the operation of the light emitting diode 2 in a manner which is not apparent to the spectator, by merely sliding the actuator 3A to the OFF position to cause the circuit on the circuit board 10 to disable the light emitting diode 2. In this regard, the spectator is mislead into thinking that the switch 3 need only be returned to its ON position to cause the diode 2 to be illuminated. However, what the spectator does not know is that the switch 3 does not control the diode 2, but it does disable the operation of the diode when its activator is slid to its OFF position. The LED 2 remains disabled even if the switch is returned to the ON position.

In order to reset the novelty device 10, as shown in FIG. 1, a resetting circuit generally indicated at 13 includes a battery 11 and a battery clip 14 attached thereto within a battery compartment 15 of the housing H, together with circuit components as hereinafter described in greater detail. An access door 7 of the compartment 15 may be opened to permit the removal of the battery 15 and its clip 14 so that the clip 14 can be disconnected from the battery and then reconnected for generating a resetting signal for the circuit of FIG. 3. The resetting of the novelty device would, of course, be accomplished without the spectator knowing, since the resetting circuit 13 is part of the secret of the operation of the novelty device 1.

Figure 3:
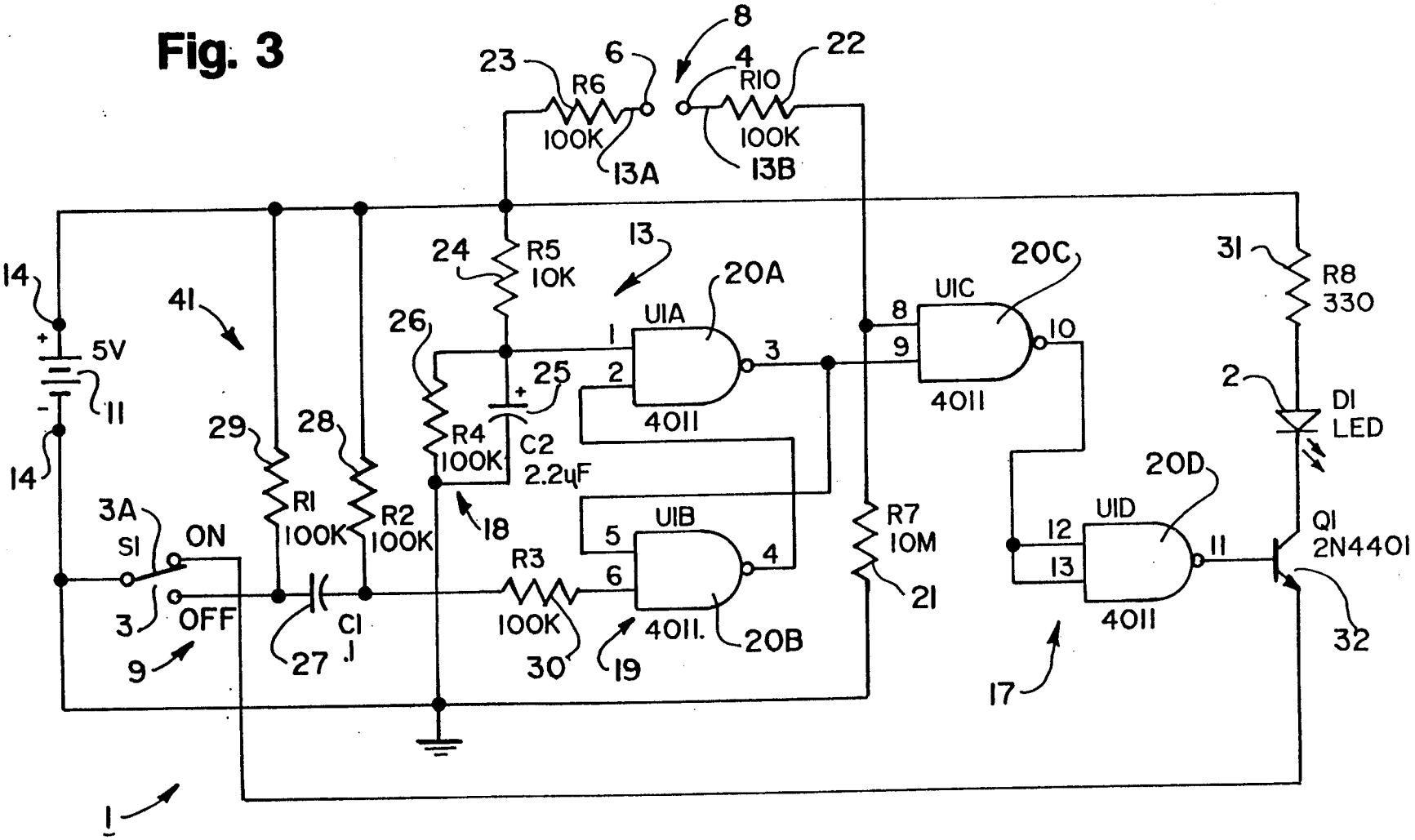
FIG. 3 is a schematic circuit diagram of the novelty device of FIG. 1.

Referring now to FIG. 3, a more detailed description of the circuit operation of the novelty device 1 will now be described in greater detail. The transistor 32 controls the operation of the light emitting diode 2, when the transistor 32 is rendered conductive. An AND circuit 17 comprising a NAND gate 20C and an invertor gate 20D, when activated, drive the transistor 32 into conduction. In order to activate the AND circuit 17, touch switch 8 is closed by the hand P, and a latch or flip-flop 19 comprising NAND gates 20A and 20B is set. For the purpose of setting the latch 19, an enabling circuit 18 comprising a capacitor 25 and a resistor 26, sets the latch 19 when the clip 14 is disconnected electrically from the battery 11 to permit the capacitor 25 to discharge through the resistor 26.

For the purpose of resetting the latch 19 to enable the hand P to activate the light emitting diode 2 following the disablement of the novelty device 1, the disabling circuit 9 further includes a differentiating circuit 41 comprising a capacitor 27, and a pair of resistors 28 and 29 to supply a negative resetting pulse to the latch 19 when the actuator 3A is moved to the OFF position of the switch 3.

In operation, hand P enables the novelty device 1 to be set by disconnecting the battery 11 from its clip 14 to cause the capacitor 25 to discharge through the resistor 26. Thus, the potential on the capacitor 25 approaches ground potential for setting the latch 19, thereby providing an enabling signal to the AND circuit 17.

As a result, the fingers of the user can provide a high impedance bridging resistance across the screws 4 and 6 forming the touch switch 8, thereby generating a sufficient driving signal for the transistor 32 via the AND circuit 17. As a result, the transistor 32 is driven in to saturation to complete a circuit, which includes the light emitting diode 2, the transistor 32, the switch 3 and the battery 11, thereby resulting in the illumination of the light emitting diode 2. In order to disarm the novelty device 1, the movement of the actuator 3A to the OFF position of the switch 3, causes a negative pulse to be supplied to the latch 19 for resetting it. Once the latch 19 is reset, then the bridging of the touch switch 8 does not permit the light emitting diode 2 to become illuminated. In this regard, the AND circuit 17 cannot be activated, since there is no enabling signal provided by the latch 19.

It should be understood that once the switch 3 has been moved from the ON to OFF position, thus disabling the touch switch 8 function, the switch actuator 3A can be slid between the ON and OFF positions by a spectator without causing the latch 19 to be set, since the only manner in which the latch 19 can be set is by discharging the capacitor 25. Furthermore, it should be noted that with the switch actuator 3A in the OFF position, there is an opened circuit condition existing for the light emitting diode and the transistor 32, thereby assuring that the light emitting diode is not illuminated inadvertently when the switch 3 is in the OFF position.

Considering now the circuit in greater detail, a resistor 31 is connected between the positive terminal of the battery 11 at the clip 14 and the light emitting diode to complete a current limiting path for it.

Considering now the touch switch 8 in greater detail, a pair of wires 13A and 13B are connected respectively between the screws 6 and 4 and a pair of current limiting resistors 23 and 22, to complete a circuit between the plus terminal of the battery 11 and one of the inputs to the gate 20C. A high impedance resistor 21 is connected between the same input of the gate 20C and ground potential, to bias the input to a logical low signal so that when the hand P bridges the screws 4 and 6 of the touch switch 8, the impedance of the hand added to resistor 22 is substantially lower than the high impedance resistor 21 for causing the potential at the logic gate 20C to be at a logic high level for enabling the gate 20C.

For the purpose of providing a charging path for the capacitor 25 of the enabling circuit 18, a current limiting resistor 24 is connected between the plus terminal of the battery and the parallel combination of the resistor 26 and the capacitor 25.

In order to provide a circuit path for the negative enabling signal from the switch 3 to the latch 19, a current limiting resistor 30 is connected between the capacitor 27 and input to the gate 20B.

While a particular embodiment of the present invention has been disclosed, it is to be understood that various different modifications are possible and are contemplated within the true spirit and scope of the appended claims. For example, it will become apparent to those skilled in the art that other types of attention attracting devices, such as buzzers or the like, may be employed. There is no intention, therefore, of limitations to the exact abstract or disclosure herein presented.

What is claimed is:

1. Novelty device, comprising:

a housing;

means mounted to said housing for generating an attention attracting signal;

apparent switch means coupled to said attention attracting means for preparing to activate it controllably by the user in an open and observable manner when it is in its activated condition;

surreptitious switch means coupled to said attention attracting means for preparing to actuate it controllably by the user in a surreptitious manner so that said attention attracting means is actuated when both said apparent and surreptitious switch means are actuated by the user;

disabling means coupled to said attention attracting means for causing another user to be unable to re-activate said attention attracting means;

means coupled to said disabling means for resetting said novelty device in a surreptitious manner to permit the first mentioned user to re-activate said attention attracting means thereafter; and means responsive to said apparent switch means in its de-actuated condition for causing said disabling means to de-actuate said attention attracting means.

2. Novelty device according to claim 1, wherein said attention attracting means includes a light producing device.

3. Novelty device according to claim 2, wherein said light producing device is a light emitting diode.

4. Novelty device according to claim 1, wherein said surreptitious switch means includes a pair of fastening devices.

5. Novelty device according to claim 1, wherein said disabling means includes a manually operable switch.

6. Novelty device according to claim 1, wherein said disabling means includes logic circuits.

7. Novelty device according to claim 6, wherein said logic circuits include and AND circuit.

8. Novelty device according to claim 7, wherein said logic circuits include a latch circuit for enabling said AND circuit.

9. Novelty device according to claim 8, wherein said resetting means includes a circuit for generating a resetting signal for the latch circuits.

10. Novelty device according to claim 9, wherein said resetting means includes enabling means.

11. Novelty device according to claim 10, wherein said resetting means includes a battery and a battery clip.

12. Novelty device, comprising:

a housing;

means mounted to said housing for generating an attention attracting signal;

switch means coupled to said attention attracting means for actuating it controllably by the user in a surreptitious manner;

disabling means coupled to said attention attracting means for causing another user to be unable to re-activate said attention attracting mans;

means coupled to said disabling means for resetting said novelty device in a surreptitious manner to permit the first mentioned user to re-activate said attention attracting means thereafter; and said disabling means includes a manually operable switch.

13. A method of operating a novelty device, comprising:

generating an attention attracting signal;

preparing to activate it controllably by the user in an open and observable manner when it is in its activated condition;

preparing to actuate it controllably by the user in a surreptitious manner so that said attention attracting means is actuated when both said apparent and surreptitious switch means are actuated by the user;

causing another user to be unable to re-activate said attention attracting means;

resetting said novelty device in a surreptitious manner to permit the first mentioned user to re-activate said attention attracting means thereafter;

causing said disabling means to de-actuate said attention attracting means.

* * * * *

UNITED STATES PATENT AND TRADEMARK OFFICE

CERTIFICATE OF CORRECTION

PATENT NO. : 5,188,565

DATED : February 23, 1993

INVENTOR(S) : Lane T. Hauck

It is certified that error appears in the above-indentified patent and that said Letters Patent is hereby corrected as shown below:

On the title page, item [54] and column 1, line 2, before "NOVELTY" insert --SURREPTITIOUSLY CONTROLLABLE--.

On the title page, item [56], after "811,702", delete "2/1960", and substitute therefor --2/1906--.

Signed and Sealed this

Twenty-fifth Day of October, 1994

*Attest:*

Bruce Lehman

BRUCE LEHMAN

*Attesting Officer*

*Commissioner of Patents and Trademarks*